US006894241B1

(12) United States Patent
Yu

(10) Patent No.: US 6,894,241 B1
(45) Date of Patent: May 17, 2005

(54) RESILIENT SWITCHING DEVICE

(76) Inventor: Tsung-Mou Yu, No. 4, Alley 2, Lane 23, Sec. 3, Pa Te Road, Panchiao City, Taipei Hsien (TW)

( * ) Notice: Subject to any disclaimer, the term of this patent is extended or adjusted under 35 U.S.C. 154(b) by 0 days.

(21) Appl. No.: 10/788,707

(22) Filed: Feb. 26, 2004

(51) Int. Cl.[7] ..... H01H 21/00
(52) U.S. Cl. ..... 200/553; 200/341
(58) Field of Search ..... 200/6 BB, 6 B, 200/6 C, 6 R, 6 BA, 11 G, 283, 293, 314, 315, 343, 344, 339, 510, 532, 400–470, 520

(56) References Cited

U.S. PATENT DOCUMENTS

| | | | | | |
|---|---|---|---|---|---|
| 4,167,720 | A | | 9/1979 | Krasser | 337/60 |
| 4,672,158 | A | * | 6/1987 | Baynes et al. | 200/283 |
| 4,937,548 | A | | 6/1990 | Sdunek | 337/75 |
| 5,082,997 | A | * | 1/1992 | Vialy | 200/452 |
| 5,089,715 | A | * | 2/1992 | Kokubu | 307/10.1 |
| 5,099,091 | A | * | 3/1992 | Kokubu | 200/5 B |
| 5,223,813 | A | | 6/1993 | Cambreleng et al. | 337/66 |
| 5,451,729 | A | | 9/1995 | Onderka et al. | 200/18 |
| 5,473,130 | A | * | 12/1995 | Pudims | 200/559 |
| 5,558,211 | A | | 9/1996 | Heydner et al. | 200/553 |
| 6,833,521 | B2 | * | 12/2004 | Nishikawa | 200/339 |

* cited by examiner

*Primary Examiner*—Elvin G. Enad
*Assistant Examiner*—Lisa Klaus

(57) ABSTRACT

A resilient switching device includes a casing, at least two electrically conductive pieces, and a resilient contact piece. An elastic strip having a turning zone is always deflected to a predetermined side normally. One end of the resilient contact piece is fixed at the top end of an electrically conductive piece while the other end is a free end having a conductive contact at a position corresponding to a conductive contact of another electrically conductive piece. When a user pushes either end of a depression key to move the resilient contact piece clamped at the gap upwards or downwards, the upper or the lower end face of the gap would depress down or prop up the turning zone of the resilient contact piece to result in a connection or disconnection between a first conductive contact and a second conductive contact to thereby effect an electric "ON" or "OFF" state.

4 Claims, 5 Drawing Sheets

(ON)

(OFF)

RESILIENT SWITCHING DEVICE

BACKGROUND OF THE INVENTION

1. Field of the Invention

The present invention relates to a resilient switching device provided with a laminated resilient contact piece characterized in deflecting to one side normally to thereby contact with or depart from an electrically conductive piece and accordingly perform an ON/OFF switching operation.

2. The Prior Arts

A power-switching device is usually built to perform ON/OFF switching operation of an electric power, of which a lower production cost is always the next goal for the makers to pursue.

The technique of switching device is well known, for example U.S. Pat. Nos. 4,167,720, 4,937,548, 5,223,813, 5,451,729, and 5,558,211. However the known technique suffers the following disadvantages:

(1) The known technique requires a great number of parts and thus a complicated structure, resulting in ease of malfunction.

(2) The great number of parts may result in delay in response time, which is disadvantageous to operation safety especially in overloading.

(3) The great number of parts causes reduction in production efficiency and increases costs.

SUMMARY OF THE INVENTION

In view of the defects mentioned, the primary object of the present invention is to provide a resilient switching device having a resilient contact piece characterized in deflecting and positioning on a constant side normally, or on another side by an external force to hence result two conductive contacts in connection or disconnection, and accordingly effect an electric "ON" state or "OFF" state.

Another object of the present invention is to provide a resilient switching device, which can be built easily with simple parts and relatively low cost.

Yet another object of the present invention is to provide a resilient switching device, in which a resilient contact piece that can jump to escape freely without being hindered by any parts is capable of responding in real time to an overload for enhancing security of using electric power.

In order to realize the above-mentioned objects, a resilient switching device constructed in accordance with the present invention comprises a casing, at least two electrically conductive pieces, and a resilient contact piece. An elastic strip having a turning zone is always deflected to a predetermined side normally and one end of the resilient contact piece is fixed at a top end of one of those electrically conductive pieces while the other end is a free end having a conductive contact corresponding to another conductive contact of another electrically conductive piece.

When a first lateral face of the resilient contact piece is pushed, the resilient contact piece is driven to bend toward a second lateral face to turn on ("ON") an electric circuit, and vice versa to turn off ("OFF") the electric circuit.

For more detailed information regarding advantages or features of the present invention, at least an example of preferred embodiment will be described below with reference to the annexed drawings.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

Figure 1:
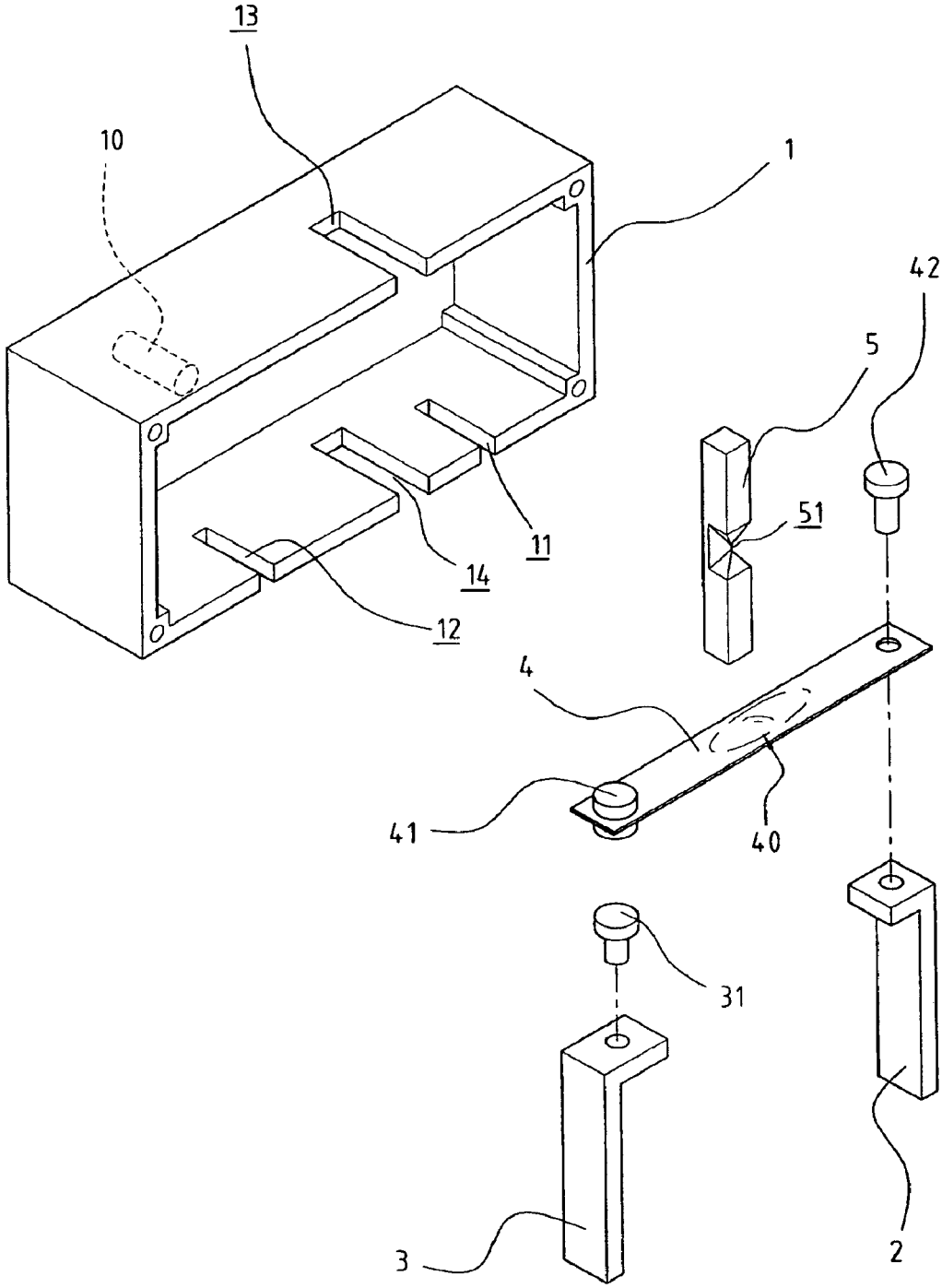
FIG. 1 is an exploded view of a resilient switching device constructed in accordance with the present invention.
Figure 2:
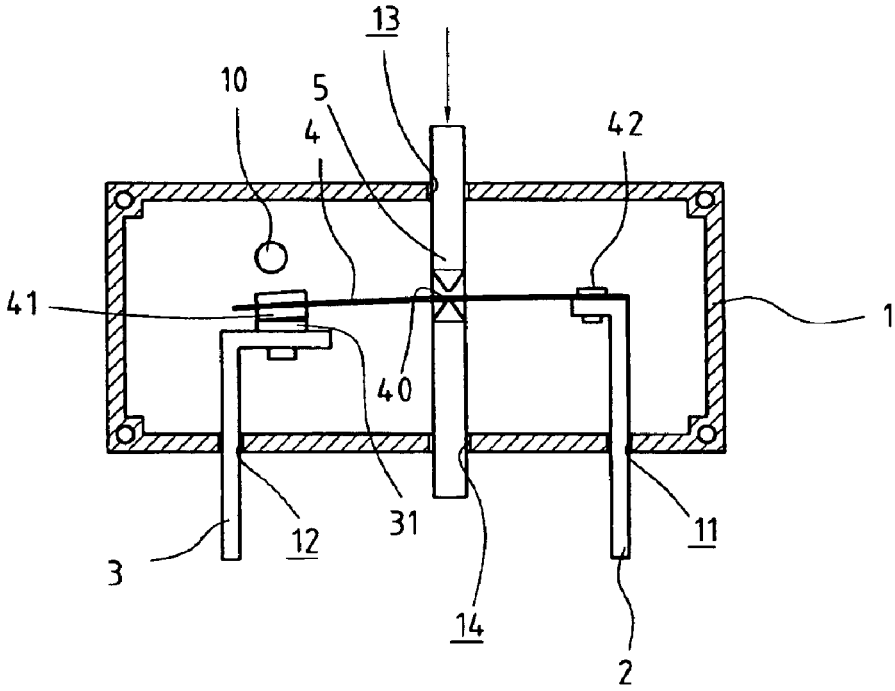
FIG. 2 is a cross-sectional view showing the resilient switching device the present invention in "ON" state.
Figure 3:
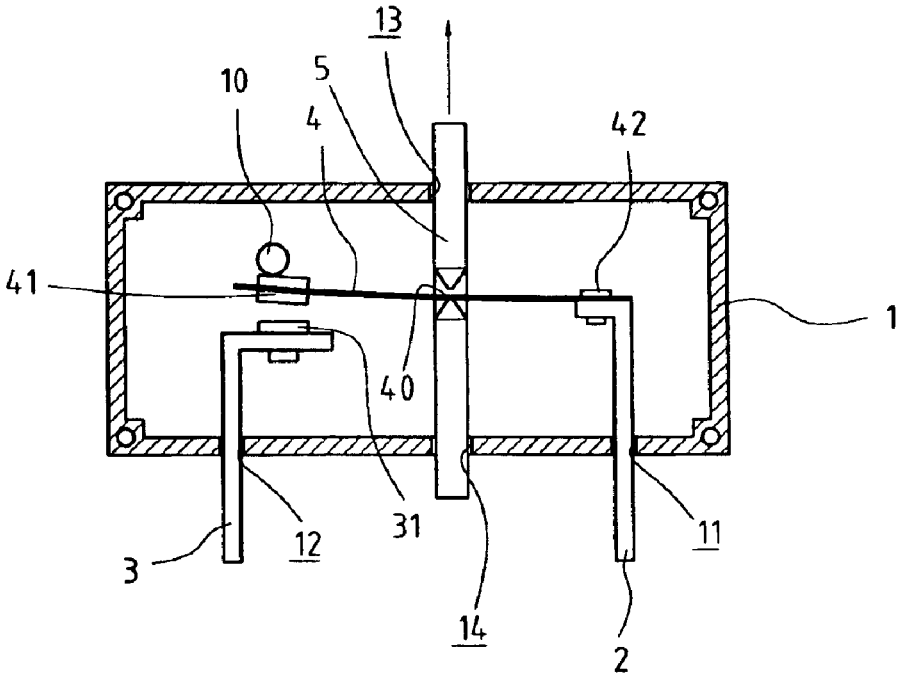
FIG. 3 is a cross-sectional view showing the resilient switching device of the present invention in "OFF" state.

With reference to the drawings and in particular to FIGS. 1–3, a resilient switching device constructed in accordance with the present invention comprises a casing 1, at least two electrically conductive pieces 2, 3, a resilient contact piece 4, and a depression key 5. The casing 1 is hollow and defines an interior space in which a rod member 10 mounted to an inner wall of the casing 1. First and second slots 11, 12 are defined in a bottom wall of the casing 1. A recess 13, 14 is formed respectively in top and bottom wall of the casing 1.

The conductive pieces 2, 3 are substantially inverted L-shaped, which extend through the first and second slots 11, 12, respectively, with ends projecting beyond the casing 1. In addition, a conductive contact 31 is attached to the conductive piece 3.

The resilient contact piece 4 is an elastic strip having a turning zone 40. The resilient contact piece 4 is always deflected to a predetermined side normally. One end of the contact piece 4 is fixed to a to end of the conductive piece 2 by a rivet 42. Alternatively, the contact piece 4 can be welded to the conductive piece 2. The other end of the contact piece 4 is a free end on which a conductive contact 41 is mounted and corresponding in position to the conductive contact 31 of the conductive piece 3.

The depression key 5 comprises a rod forming a gap 51 in a middle portion. Upper and lower end faces of the gap 51 are tapered to clamp the contact piece 4 therebetween. Two ends of the depression key 5 extend through the recesses 13, 14 of the casing 1 whereby the depression key 5 is movable with respect to the casing 1 by being guided by the recesses 13, 14.

Referring to FIG. 2, in an "ON" state, the turning zone 40 of the resilient contact piece 4 is turned downwards so that the resilient contact piece 4 is deflected downwards with the conductive contact 41 engaging the conductive contact 31 to form a closed loop.

When depression key 5 is depressed, the gap 51 that clamps the resilient contact piece 4 displaces downwards. At this moment, the tapered upper end face of the gap 51 props down the turning zone 40, making the resilient contact piece 4 concave upward, so that the conductive contact 41 warps up and disengage from the conductive contact 31 thereby opening the loop, as shown in FIG. 3. Under the "OFF" state as indicated in FIG. 3, by pushing the depression key 5 upwards, the resilient contact piece 4 clamped in the gap 51 is moved upwards while the free end thereof is stopped by the rod member 10 in the casing 1 to hence result in a warp up of the turning zone 40 of the resilient contact piece 4 by the associated upward-going tapered lower end face of the gap 51 and a downward-going of the contact piece 4 that makes the conductive contact 41 engaging the conductive contact 31 to return back to the "ON" state.

The resilient contact piece 4 can be made of an alloy having the characteristics that deflects to one side in normal temperature and bends to the other side at a temperature beyond a threshold temperature. In the embodiment illustrated, the contact piece 4 always bends down normally. In the "ON" state shown in FIG. 2, when overloading happens, which heats up the resilient contact piece 4 over the threshold temperature, the resilient contact piece 4 deforms upwards so that the conductive contact 41 at the free end of the resilient contact piece 4 disengages from the conductive contact 31 through an upward bounce of the turning zone 40 to thereby enter the "OFF" state as shown in FIG. 3.

Figure 4:
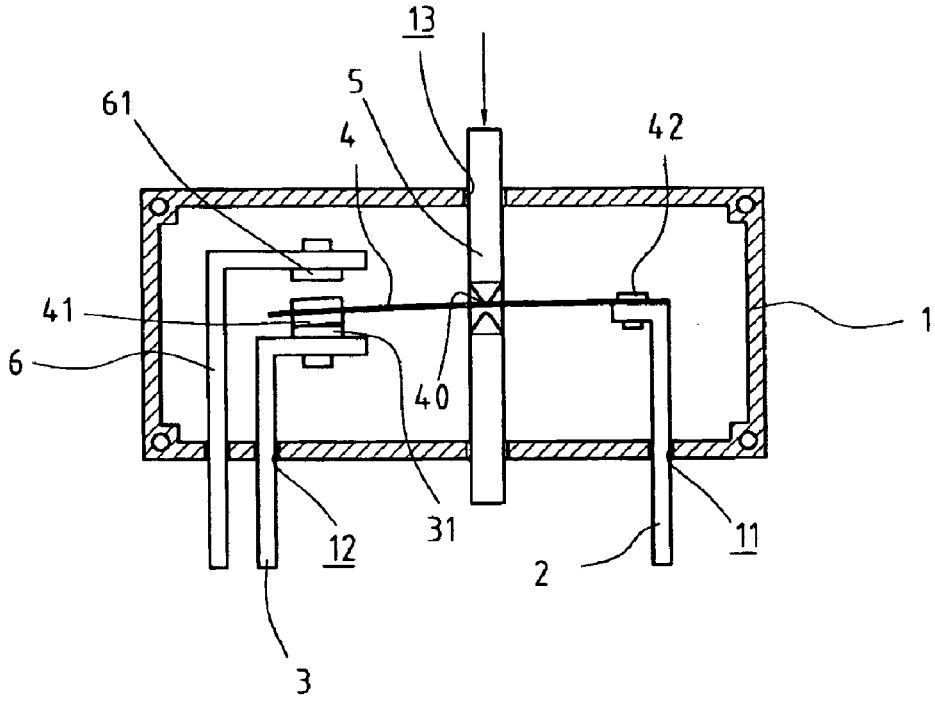
FIG. 4 is a cross-sectional view showing the resilient switching device of the present invention, in which a first circuit is in "ON" state.
Figure 5:
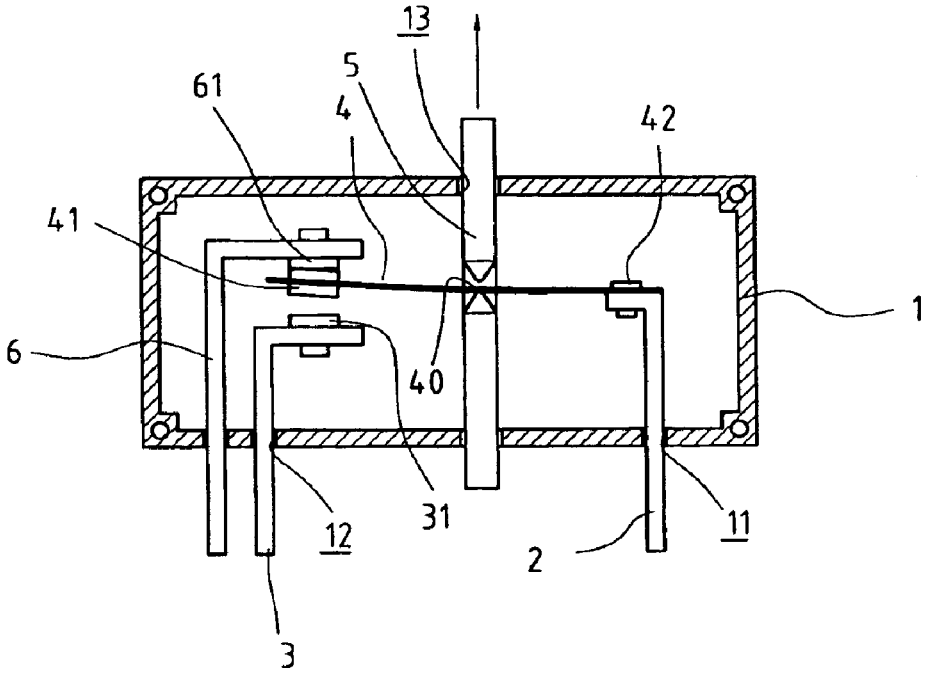
FIG. 5 is a cross-sectional view showing the resilient switching device of the present invention, in which a second circuit is in "ON" state.

Also referring to FIGS. 4 and 5, a second embodiment of the present invention is shown, in which a first circuit is in "ON" and "OFF" state, respectively. A conductive piece 6 that is substantially an inverted L-shape plate is received in the casing 1 with one end extending outside the casing 1. A conductive contact 61 is fixed to another end of the conductive piece 6.

When the depression key 5 is depressed at either one of the ends thereof, the resilient contact piece 4 clamped at the gap 51 is moved upwards or downwards, and the tapered upper and lower end faces of the gap 51 prop against the turning zone 40 of the resilient contact piece 4 to result in engagement between the conductive contact 41 and the conductive contact 31, or between the conductive contact 41 and the conductive contact 61 to thereby effect an electric "ON" state of a first or a second circuit.

In the above described, at least one preferred embodiment has been described in detail with reference to the drawings annexed, and it is apparent that numerous changes or modifications may be made without departing from the true spirit and scope thereof, as set forth in the claims below.

What is claimed is:

1. A resilient switching device comprising:

a casing that is hollow and defines an interior space, the casing forming at least two slots and two recesses;

two electrically conductive pieces received in the slots of the casing respectively, a first conductive contact fixed on a first one of the conductive pieces;

a resilient contact piece comprising an elastic strip having a turning zone and deflected to a predetermined side normally, one end of the resilient contact piece being fixed to at a second one of the conductive pieces and the other end being provided with a second conductive contact at a position corresponding to the first conductive contact of the first conductive piece; and a depression key forming a gap at a middle part for clamping the resilient contact piece, and two ends of the depression key movably extending through the recesses of the casing;

wherein by pushing either end of the depression key to move the resilient contact piece clamped at the gap upwards or downwards, the upper or the lower end face of the gap depress down or prop up the turning zone of the resilient contact piece to selectively result in engagement/disengagement between the first conductive contact and the second conductive contact, thereby selectively effecting "ON" or "OFF" state.

2. The resilient switching device according to claim 1, wherein the resilient contact piece is made of an alloy having characteristics that deflects to one side under normal temperature and bounces to the other side beyond a predetermined threshold temperature.

3. The resilient switching device according to claim 1, wherein both the upper and the lower end faces of the gap in the depression key are tapered.

4. The resilient switching device according to claim 1, wherein a third conductive piece which is substantially an inverted L-shaped plate has one end extending outside the casing, a third conductive contact fixed to the third conductive piece at a position corresponding to the second conductive contact of the resilient contact piece and wherein by pushing either end of the depression key, the resilient contact piece clamped at the gap is moved upwards and deflected such that the first and second conductive contacts engage each other to effect an "ON" state of a first electric circuit, or making the resilient contact piece clamped at the gap move downwards and get deflected such that the second conductive contact engages the third conductive contact to effect an "ON" state of a second electric circuit.

* * * * *